US005947198A

United States Patent [19]

McKee et al.

[11] Patent Number: 5,947,198

[45] Date of Patent: Sep. 7, 1999

[54] DOWNHOLE TOOL

[75] Inventors: L. Michael McKee, Alvin; Michael L. Smith, Missouri City; Patrick W. Bixenman, Houson; Bruce W. Boyle, Sugar Land, all of Tex.

[73] Assignee: Schlumberger Technology Corporation, Sugar Land, Tex.

[21] Appl. No.: 08/837,806

[22] Filed: Apr. 22, 1997

Related U.S. Application Data

[60] Provisional application No. 60/015,252, Apr. 23, 1996.

[51] Int. Cl.[6] ..... D21B 23/04

[52] U.S. Cl. ..... 166/66.4; 166/377

[58] Field of Search ..... 166/377, 68.1, 166/66.4, 66.6, 66.7, 242.2, 242.6

[56] References Cited

U.S. PATENT DOCUMENTS

| | | | |
|---|---|---|---|
| 4,364,587 | 12/1982 | Samford . | |
| 4,375,237 | 3/1983 | Churchman . | |
| 4,535,842 | 8/1985 | Ross . | |
| 4,550,935 | 11/1985 | Marshall et al. . | |
| 4,659,115 | 4/1987 | Cameron . | |
| 4,936,618 | 6/1990 | Sampa et al. . | |
| 4,971,147 | 11/1990 | Thomeer . | |
| 4,984,632 | 1/1991 | Sampa et al. . | |
| 5,050,682 | 9/1991 | Huber et al. . | |
| 5,133,412 | 7/1992 | Coronado . | |
| 5,257,663 | 11/1993 | Pringle et al. . | |
| 5,323,853 | 6/1994 | Leismer et al. . | |
| 5,353,877 | 10/1994 | DeCorps et al. | 166/66.4 |
| 5,468,153 | 11/1995 | Brown et al. . | |
| 5,486,695 | 1/1996 | Schultz et al. . | |
| 5,490,564 | 2/1996 | Schultz et al. . | |
| 5,505,261 | 4/1996 | Huber et al. . | |
| 5,580,114 | 12/1996 | Palmer . | |
| 5,810,088 | 9/1998 | Lamirand et al. | 166/66.4 |

*Primary Examiner*—William Neuder
*Attorney, Agent, or Firm*—Browning Bushman

[57] ABSTRACT

A downhole tool (12) connected to the lower end of a coiled tubing string (14). A wireline cable (16) extends downwardly through the coiled tubing string (14) and through the center of the tool (12) to define an annulus between the cable (16) and the outer housing (66). Annular valves (98, 100) control annulus fluid flow. A clamping device (26) releasably secures the wireline cable (16). The disconnect for the downhole tool (12) comprises an electrically activated fluid pressure mechanism for releasing disconnect dogs or latches (116, FIG. 1H) carried by an upper tool portion (12A) and releasably securing a lower tool portion (12B). The fluid actuated mechanism is activated by an electrical solenoid valve (124) to permit actuation of a disconnect piston (148) by communicating pressurized hydraulic fluid in a reservoir (168) through fluid passages 170, 158 to a piston fluid chamber (156). Upon a predetermined fluid pressure provided between internal fluid in the tool and external fluid in the well, piston (148) moves downwardly to contact and move retainer sleeve (140) downwardly to permit the locking dogs (116) to retract within the recess (144) of retainer sleeve (140) as shown in FIG. 4B to release upper tool portion (12A) from lower tool portion (12B).

18 Claims, 10 Drawing Sheets

DOWNHOLE TOOL

CROSS-REFERENCE TO RELATED PROVISIONAL APPLICATION

This application claims the benefit of U.S. Provisional Application Ser. No. 60/015,252 filed Apr. 23, 1996 and entitled Coiled Tubing Drilling Head.

FIELD OF THE INVENTION

This invention relates to downhole tools for oil and gas wells, and more particularly to such a downhole tool in which a coiled tubing string having a wireline cable therein is connected to the downhole tool.

BACKGROUND OF THE INVENTION

Wireline operations are commonly provided with coiled tubing and an electrical cable for such wireline operations is usually housed or received within the coiled tubing for extending downhole. A wireline may be used with various instruments such as surveying and steering, electrical resistance sensing, weight-on-bit measuring tools, tachometers for drill motors, for example. These instruments are connected to the surface with a wireline for the transmission of data. The data is processed, displayed, or inputted within a computer in accordance with state of the art. Thus, it is desirable that a tool be provided for coiled tubing having a wireline extending from the surface downwardly within the coiled tubing and the associated tool for receiving and/or sending data to various downhole instruments. Further, it is desirable that a downhole tool be provided in which the wireline cable extends centrally of the tool with fluid flow down its tube being about the centrally located incline cable.

In well operations, with the insertion and retrieval of tubular materials from a well, it is not uncommon to have a tool located at the lower end of a tubing string to become stuck in the well. Rather than leave the entire tubing string in the wellbore, it is occasionally desirable to break the connection between the tool and the remaining portions of the tubing string so that with retrieval of the tubing string, only a small portion of the well is blocked by the stuck tool. A fishing tool may then be used for removal of the stuck tool. In some instances an upper portion of the tool is removed with the tubing string so that only the lower portion of the tool remains in the well.

Many tool release mechanisms are used for this purpose. The most common joints between tubing and the well tool involve a threaded interconnection or a common J-latch arrangement. The release of these joints, however, necessitates the rotation of the tubing string in order to effect release of the coupling. In coiled tubing operations, it is virtually impossible to effect rotational movement of the tubing string particularly with long horizontal sections in deviated wells. With tubing string systems other than coiled tubing systems, it may be undesirable to employ rotational movement of the string even though such rotation may be possible.

Coupling means which do not require rotation of the tubing string such as compression or Belleville springs do not provide sufficient holding force for maintaining the coupling interconnection at all times when it is desired. Release of such couplings resulting from minor impacts can lead to expensive fishing/retrieval operations which might not otherwise be required. Such couplings also require a large amount of annular space for the release mechanism.

U.S. Pat. No. 4,984,632 dated Jan. 15, 1991 shows a tool disconnect or tool release joint for a tool connected to coiled tubing. The tool release joint utilizes a hydraulic release coupling in which the release pressure can be adjusted over a wide range. Most of the disconnect system heretofore have utilized either tension or pressure to actuate the release mechanism. These disconnect systems may easily be actuated unintentionally and may be difficult to operate under certain conditions, such as long horizontal sections in deviated wells. It is desirable that tool release mechanisms have two separate operations in order to effect actuation of the release mechanism in order to minimize any inadvertent actuation of the release mechanism.

U.S. Pat. No. 5,323,853 dated Jun. 28, 1994 is directed to a downhole disconnect tool which utilizes an electrical signal to actuate the disconnect mechanism. The disconnect mechanism may also be separately actuated by hydraulic actuation. Thus, the disconnect tool may be separated or disconnected by either hydraulic actuation or electrical actuation to provide a redundancy. There is no cooperative effort between the electrical actuation and the hydraulic actuation as each operates independently of the other. Further, a separate hydraulic fluid line extending to surface is required for the operation of the hydraulic actuation.

SUMMARY OF THE INVENTION

The present invention is particularly directed to a downhole tool connected to the lower end of a coiled tubing string with a wireline cable received within the coiled tubing string and extending downwardly from the coiled tubing centrally of the tool. Well fluids, such as drilling fluid, flow down the tool in an annular space about the centrally positioned wireline cable and annular valves in the annular space are effective to prevent the upward flow of annulus fluid.

An annular flow path for the annulus fluid, such as drilling fluid, is maintained between the wireline cable and the outer tool housing. A pair of axially spaced annular check valves are provided in the annular flow path to permit fluid flow down the coiled tubing but preventing fluid flow up the coiled tubing. The orifices of the annular check valves may be adjusted or changed to provide a predetermined pressure drop at a predetermined flow rate.

The wireline cable is anchored by a clamping device at a location below the lower end of the coiled tubing at the upper end of the downhole tool. A shear release mechanism is connected to the clamping device and a predetermined tensile load on the wireline cable is effective to shear the release mechanism and permit the wireline to be retrieved from the coiled tubing in the event the coiled tubing becomes stuck in the well.

An additional feature of particular importance during assembly of the downhole tool is the rotatable connection joint for the wireline cable utilizing mating male and female connectors so that multiple conductors or leads in the wireline cable may be connected together without being axially aligned or oriented. The male and female connectors may rotate relative to each other while maintaining electrical contact among the multiple electrical conductors which are axially spaced.

The present invention is preferably utilized with a disconnect mechanism for the downhole tool in which the operation of the release mechanism or release joint does not depend on rotation of the tubing string to effect release and retrieval of the tool. This is important especially for coiled tubing as it is very difficult to effect rotational movement of the relatively small diameter coiled tubing string particularly when the tubing string is deviated and includes a relatively long horizontal section for the deviated well. A wireline cable including one or more insulated conductors extends downwardly from the surface through the coiled tubing and the tool. The wireline is effective for the transmission and receiving of data to and from various instruments and to provide electrical signals for various functions and operations of the downhole tool.

The release mechanism for the disconnect system of this invention is first initiated by an electrical signal transmitted by the wireline. The electrical signal is effective to activate the fluid operated release mechanism which effects release of the coiled tubing and upper tool portion from a lower tool portion and well housing for surface retrieval thereby to provide an electrically operated release for downhole tools. The electrically activated fluid operated release mechanism is effective when activated by an electrical signal to provide fluid flow for movement of a piston to effect unlocking of locking latches releasably locking the coiled tubing string and upper tool section to the lower tool section. Thus, two separate operations are required for effecting unlocking of the release mechanism, an initial operation which includes the transmitting of an electrical signal from surface, and a second operation in which a fluid operated release mechanism is activated by an electrical signal and is actuated at a predetermined fluid pressure differential between pressurized hydraulic fluid and the annulus fluid of the tool to effect release of locking latches.

The disconnect system of the present invention thus utilizes an electrical signal to activate a fluid operated release mechanism for disconnecting an upper tool portion from a lower tool portion. The fluid operated release mechanism cannot be actuated without the electrical signal which activates the fluid operated release mechanism which utilizes pressurized hydraulic fluid. After the fluid operated release mechanism is activated, the differential fluid pressure between the annulus fluid, which normally is drilling fluid, and the pressurized hydraulic fluid must reach a predetermined amount before the fluid operated release mechanism is actuated to effect a disconnect of the upper tool portion and coiled tubing string from the lower tool portion. The fluid operated release mechanism utilizes hydraulic fluid and a pressurized hydraulic fluid reservoir is provided within the tool for the supply of hydraulic fluid. Thus, a separate hydraulic line to surface for the supply of hydraulic fluid is not required.

It is an object of the present invention to provide a downhole tool on the lower end of a coiled tubing string with a wireline cable received within the coiled tubing string and extending downwardly centrally of the tool to provide simple non-oriented connections.

An additional object of this invention is the provision of a downhole tool having a wireline cable extending along the center of the tool with fluid flow downwardly about the wireline cable controlled by annular valves in an annulus between the wireline cable and outer tool housing to provide a maximum flow area downhole at a minimum pressure drop.

Another object of this invention to provide an electrically activated fluid operated downhole tool mechanism for disconnect of a coiled tubing string from a downhole tool.

A further object of this invention is the provision of such an electrically activated fluid operated downhole tool release for a coiled tubing string having a wireline cable extending downwardly through the coiled tubing string.

Another object of this invention is to provide a tool disconnect for a coiled tubing string in which a wireline cable within the coiled tubing string has a release mechanism to permit release of the wireline cable from the coiled tubing string upon tensioning of the wireline cable a predetermined amount.

A further object of the invention is the provision of a tool disconnect for a coiled tubing string which requires at least two separate inputs to operate the disconnect mechanism thereby to permit the operating level of each input to be at a lower threshold than required for a single input system.

Other objects, features, and advantages of this invention will be apparent from the following specification and drawings.

DESCRIPTION OF THE INVENTION

Figure 1A:
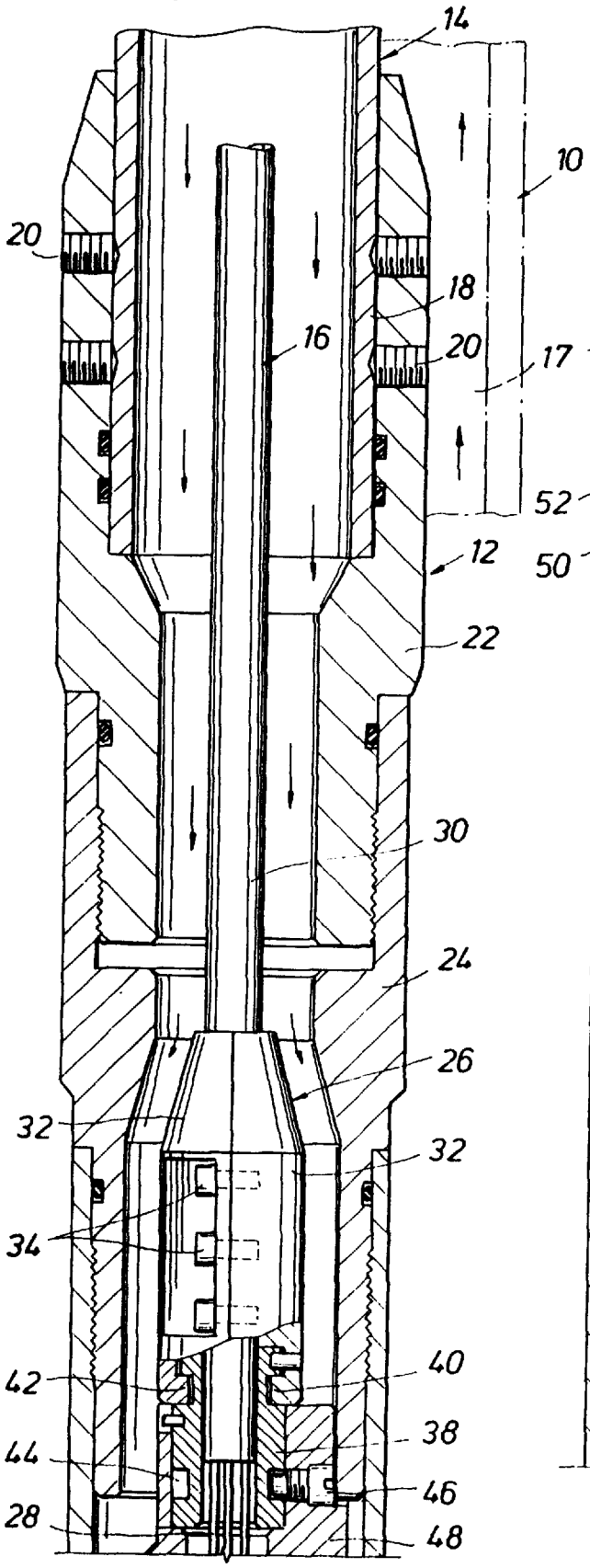
FIGS. 1A–1H are continuous longitudinal sectional views in sequence of the downhole tool comprising the present invention connected to the lower end of a coiled tubing string with a wireline therein and having a disconnect for separating an upper tool portion from a lower tool portion for retrieval of the upper tool portion and coiled tubing string.
Figure 1B:
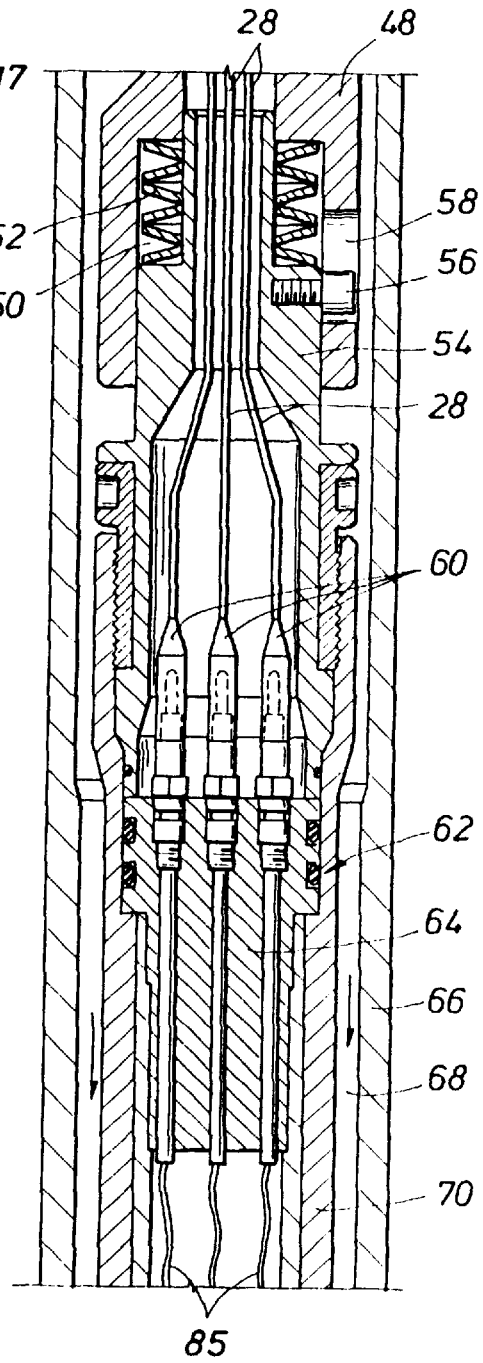

Referring now to FIGS. 1A–1H, continuous sectional views in sequence show the downhole tool of the present invention connected at its upper end to a coiled tubing string and adapted for connection at its lower end to a downhole motor and associated drill bit (not shown). Referring particularly now to FIGS. 1A and 1B, a bore hole for a well has an outer casing shown generally at 10 in broken lines. The downhole tool is shown generally at 12 connected to the lower end of a coiled tubing string 14 extending to a surface location. An annulus 17 is defined between outer casing 10 and downhole tool 12. A wireline cable shown generally at 16 extending from a surface location is received within coiled tubing string 14. Drilling fluid is pumped downwardly through the coiled tubing string 14 to downhole motor and formation cuttings entrained with drilling fluid are returned through annulus 17 to a surface location for separation. The downhole motor (not shown) may be driven by pressurized drilling fluid or by electric power.

Clamping Device and Shear Release For Wireline Cable-FIGS. 1A, 1B

A lower end portion 18 of coiled tubing string 14 is secured by suitable set screws 20 to a coiled tubing connector 22 defining the upper end of tool 12. A drain sub 24 having a suitable drain valve (not shown) is connected to coiled tubing connector 22 and receives a clamping device generally indicated at 26 for anchoring armored wireline cable 16 which has a plurality of insulated leads or conductors 28 within an outer protective sheath 30. Clamping device 26 includes a pair of mating clamping halves secured by threaded bolts 34 about cable 16. A lower cable clamp ring 38 has an upper groove 40 receiving an inwardly extending flange 42 on clamping halves 32. Ring 38 has a lower annular groove 44 receiving shear pins 46 on an upper spring housing 48. Ring 38 and clamping halves 32 are thus mounted for rotation relative to upper spring housing 48. Upper spring housing 48 has a lower recess 50 receiving a compression spring 52 therein biased by lower spring housing 54. A key 56 on lower spring housing 54 is mounted within a slot 58 on upper spring housing 48 to provide relative axial movement between housings 48 and 54.

Electric leads 28 have plugs or boots 60 which are easily disconnected upon tensioning of leads 28. By permitting relative axial movement between housings 48 and 54, adjustments for various tolerances are provided to assist in the assembly of tool 12. In the event coiled tubing string 14 becomes stuck in the bore hole, wireline cable 16 may be retrieved by tensioning of cable 16 resulting in shearing of pins 46 to disconnect clamping device 26 from spring housing 48. The tensioning force in cable 16 required for shearing pins 46 may be adjusted by changing the sheared cross sectional area of pins 46. Tensioning of conductors 28 result in a release of plugs 60 to permit retrieval of wireline cable 16 including clamping device 26 to a surface location.

Male and Female Connectors For Wireline Cable-FIGS. 1B, 1C, 1D, 3A and 3B

Figure 1C:
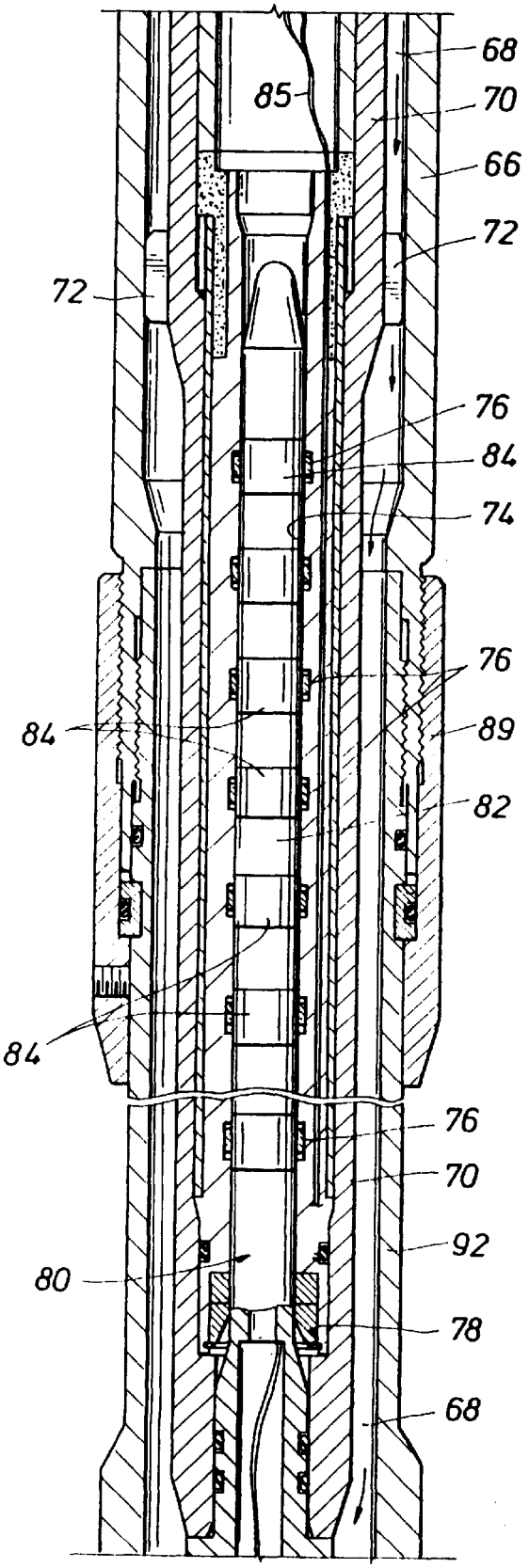
Figure 2A:
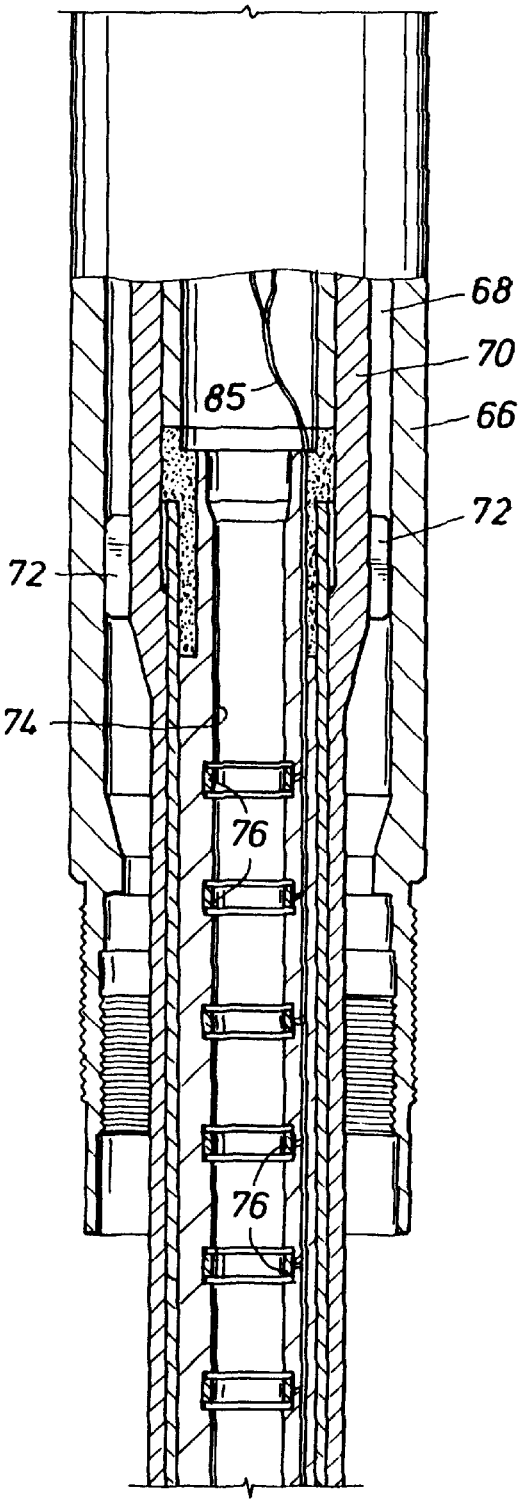
FIGS. 2A and 2B are continuous longitudinal sectional views of an electrical connector assembly for the wireline showing a male connector and female connector separated and, adapted for assembly in mating electrical contact without any axial alignment of the multiple conductors to permit relative rotation between the male and female connectors during assembly.
Figure 2B:
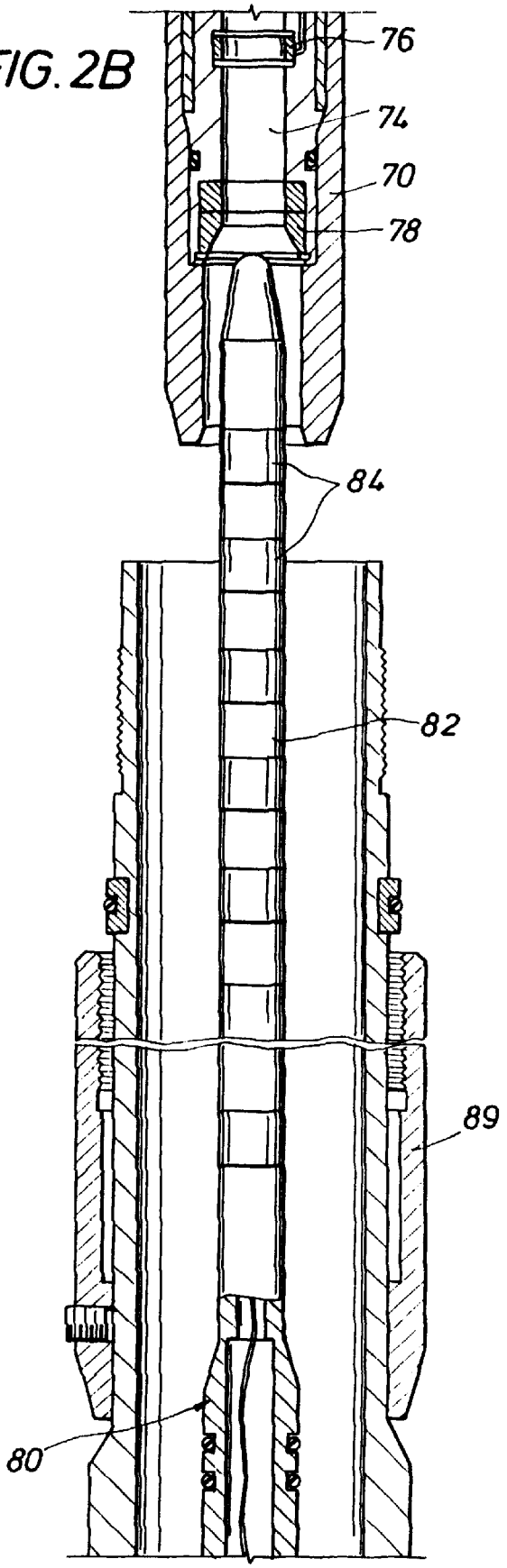

It is desirable that the electrical connection between the lower bottom hole assembly and the upper coiled tubing assembly be easily assembled with a quick stab electrical connection utilizing a female electrical connector and a mating male connector which do not require axial alignment of the multiple conductors and may rotate relative to each other. FIG. 1B shows a female connector assembly generally at 62 having an upper body 64 for connection to conductor plugs 60. An outer female connector housing is shown at 66 and defines an annulus 68 with inner female housing 70. Splines 72 on inner housing 70 maintain inner housing 70 in concentric relation with outer housing 66 as shown in FIG. 1C. Inner housing 70 has a central bore 74 with a plurality of axially spaced inner electrical contact rings 76 therein with a separate contact ring 76 for each electrical lead 85 (see also FIGS. 2A and 2B). A tapered guide 78 is mounted within bore 74 adjacent the lower end of inner housing 70 as shown also in FIG. 2B.

Figure 1D:
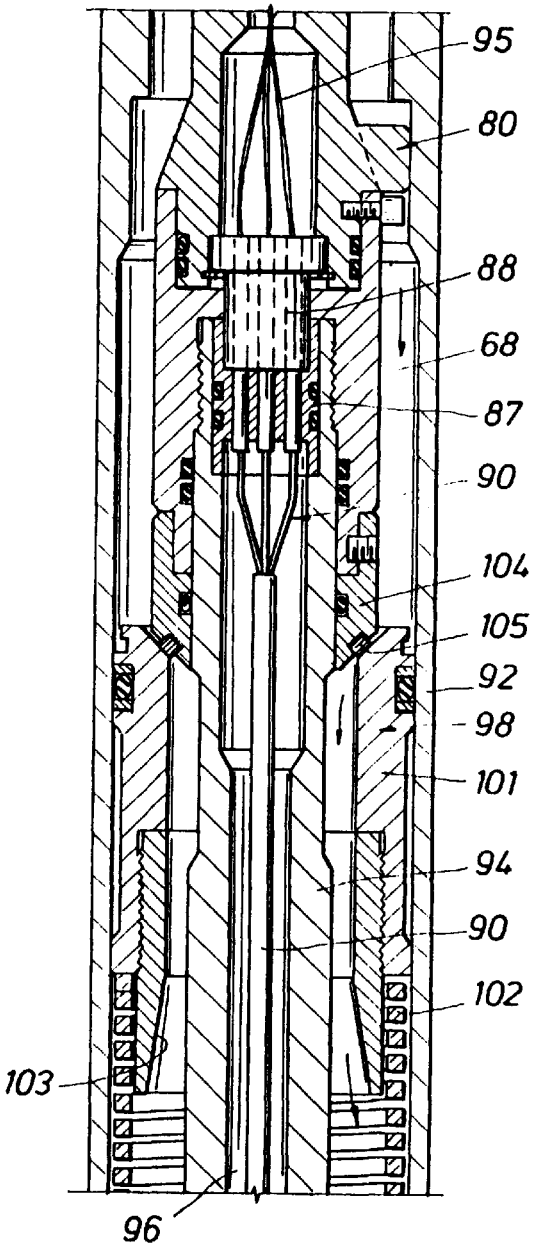

A male connector assembly is shown generally at 80 including a male connector 82 having a plurality of spaced electrical contact bands 84 adapted to be positioned in mating relation with opposed contact rings 76 of female connector assembly 62 in the mated position shown in FIG. 1C after male connector 82 is stabbed or injected within inner female connector housing 70. Each contact band 84 is electrically connected with a separate conductor 95. A conductor guide or plug 88 has conductors 95 connected to its upper end. Plug 88 fits within a receptacle or bulkhead 87 and conductor harness 90 extend downwardly from receptacle 87 as shown in FIG. 1D. A collar 89 releasably secures male connector 82 to outer female housing 66.

Figure 1E:
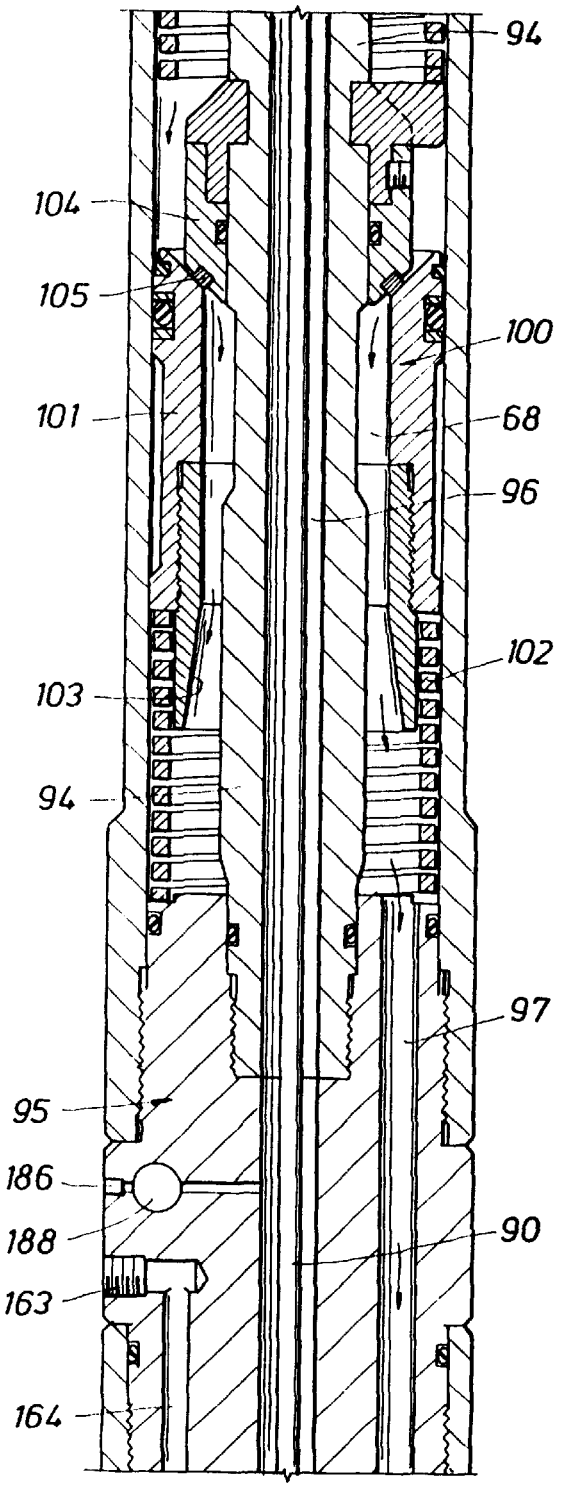

Annular Check Valves-FIGS. 1D and 1E

A spline sub or outer tool housing 92 is connected to the lower end of female connector housing 66 to define annulus 68 between outer housing 66 and inner housing or mandrel 94 as shown in FIGS. 1D and 1E. Mandrel 94 has a bore 96 receiving wireline cable 16. An upper disconnect sub 95 is connected to the lower end of mandrel 94. A generally semicircular passage 97 in sub 95 receives fluid from annulus 68. A conductor retainer 88 closes the upper end of bore 96 in mandrel 94. A pair of axially spaced annular check valves generally indicated at 98, 100 shown in FIGS. 1D and 1E are mounted in annulus 68. Each check valve 98, 100 has a piston valve member 101 urged by spring 102 toward a closed position on seat 104 secured to mandrel 94. Piston valve member 101 has a tapered orifice 103. An annular elastomeric seal 105 on seat 104 seals against the associated check valve 98 or 100 in closed position. A fluid pressure differential in closed position is created between the upper and lower ends of piston valve member 101 from fluid pressure from the downward flow of fluid from coiled tubing string 14. The upper face of piston valve member 101 between seal 105 and outer tool housing 92 is exposed to fluid in annulus 68 in the closed position of valve 98. When valve 98 opens, the entire outer face of piston valve member 101 including the portion radially inward of seal 105 is exposed to fluid pressure for effecting movement of valve 98 to full open position.

The opening force required to open valve 98 may be varied by changing the location of seal 105. The gap between piston valve member 101 and seat 104 at annular seal 105 in the open position of check valve 98 or 100 and the annular space between mandrel 94 and tapered orifice 103 can be predetermined to provide a desired pressure drop across valves 98, 100. When valves 98, 100 are in closed position, only a relatively small area of piston valve member 101 at seat 104 is exposed to fluid pressure to limit axial loading of valves 98, 100 in an upward direction. Annular check valves 98, 100 in annulus 68 for the fluid are particularly useful when harness 90 extends along the center of tool 12 as in the present invention. Annular check valves 98, 100 may be adjusted for remaining open at a predetermined flow rate. The cross sectional area for fluid flow along the length of tool 12 is generally uniform so that substantial pressure differentials are not created. Thus, the cross sectional areas of semicircular passage 97 and the annulus above and below valves 98, 100 are generally similar.

Tool Disconnect-FIGS. 1E–1H

Figure 5A:
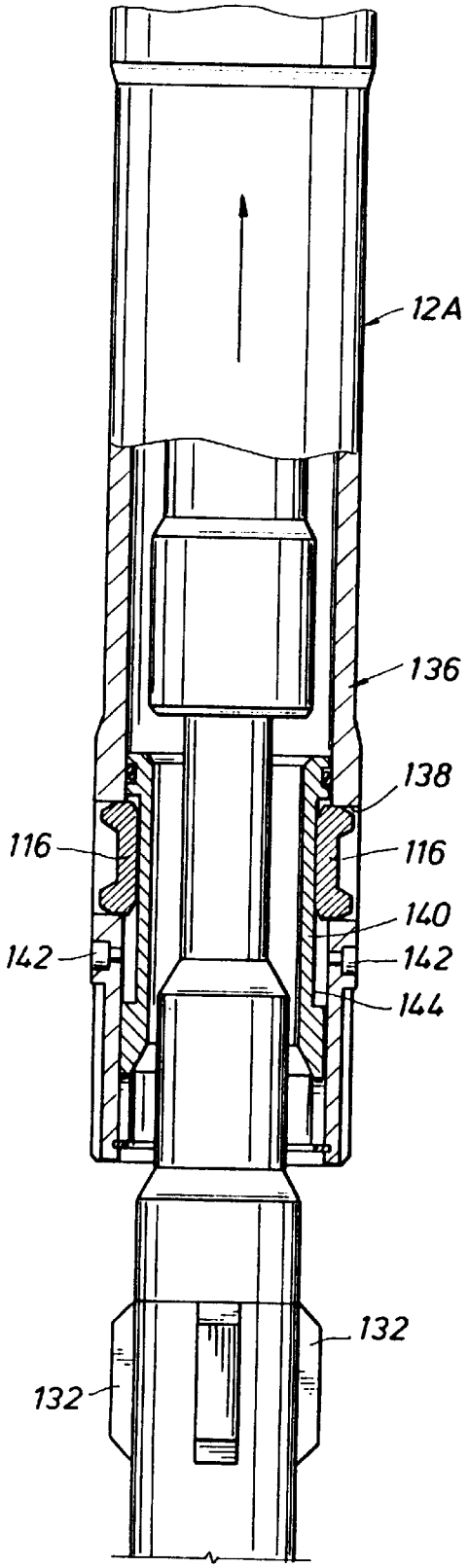
FIGS. 5A and 5B are continuous sectional views after disconnect showing the upper tool portion separated from the lower tool portion and partially removed from the lower tool housing which remains downhole.
Figure 5B:
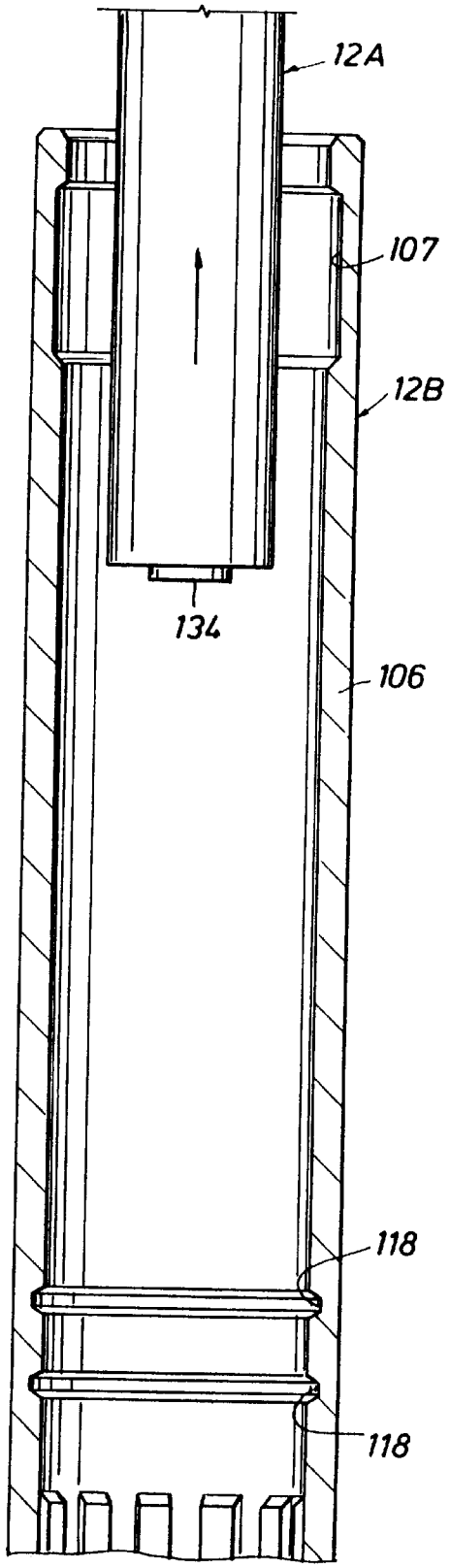

The disconnect for tool 12 as shown particularly in FIGS. 1E–1H includes an upper tool portion 12A which is released from a lower tool portion 12B for retrieval of coiled tubing string 14 and upper tool portion 12A to the surface (see FIGS. 5A, 5B also). The lower tool portion 12B remains downhole after disconnect and retrieval of upper tool portion 12A. Lower tool portion 12B as shown particularly in FIGS. 1G, 1H and 5B includes a lower housing 106 having a upper fishing neck 107 and a crossover sub 108 threaded to the lower end of lower housing 106. A key 110 connects crossover sub 108 to a downhole housing 112 and is secured to downhole housing 112 by a split nut 114. Fishing operations after disconnect and retrieval to the surface of upper tool portion 12A may be commenced by connection of a fishing tool to fishing neck 106 and crossover sub 108.

Figure 1F:
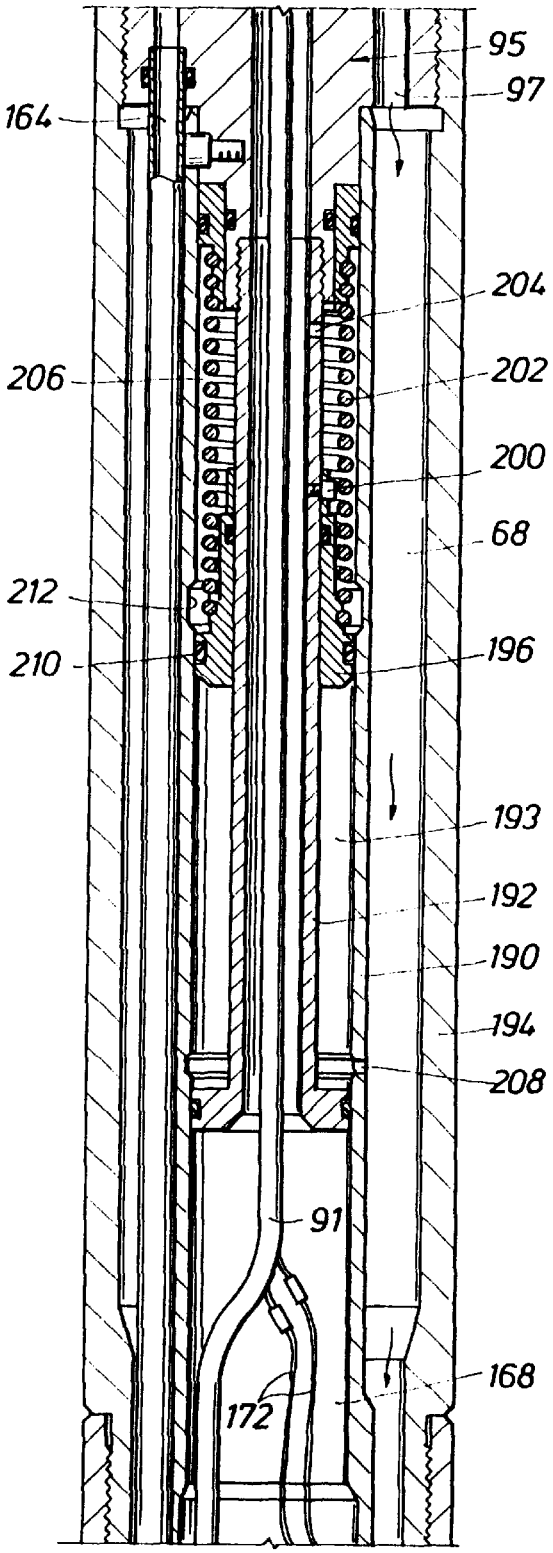
Figure 1G:
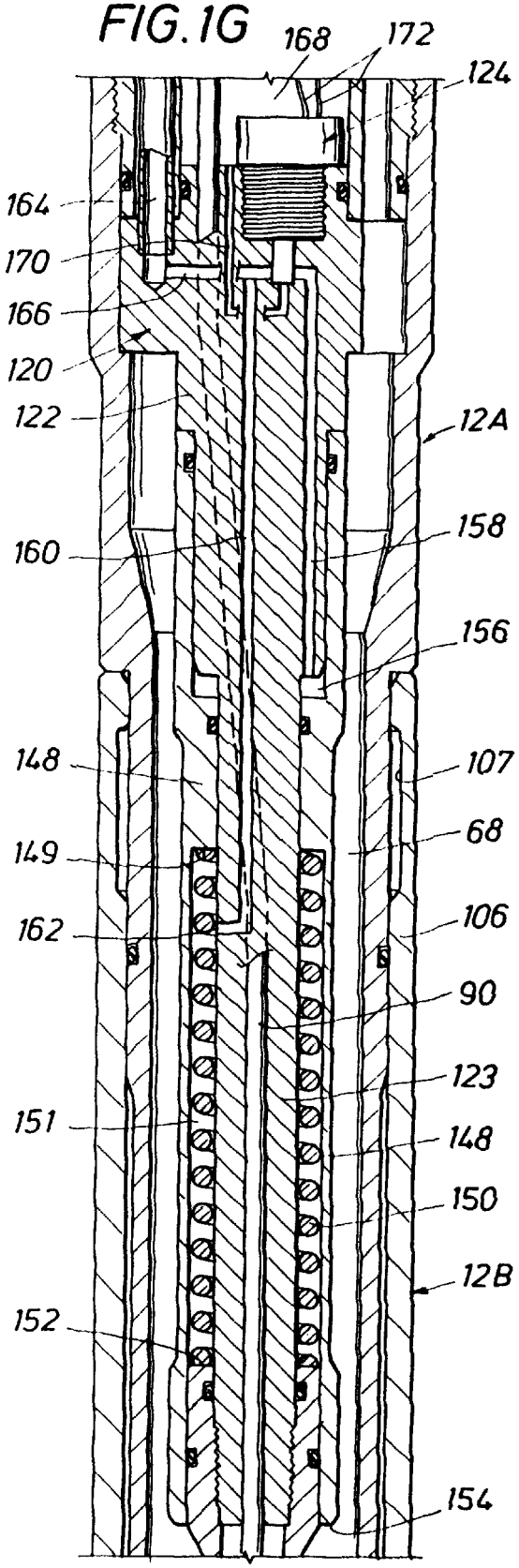
Figure 1H:
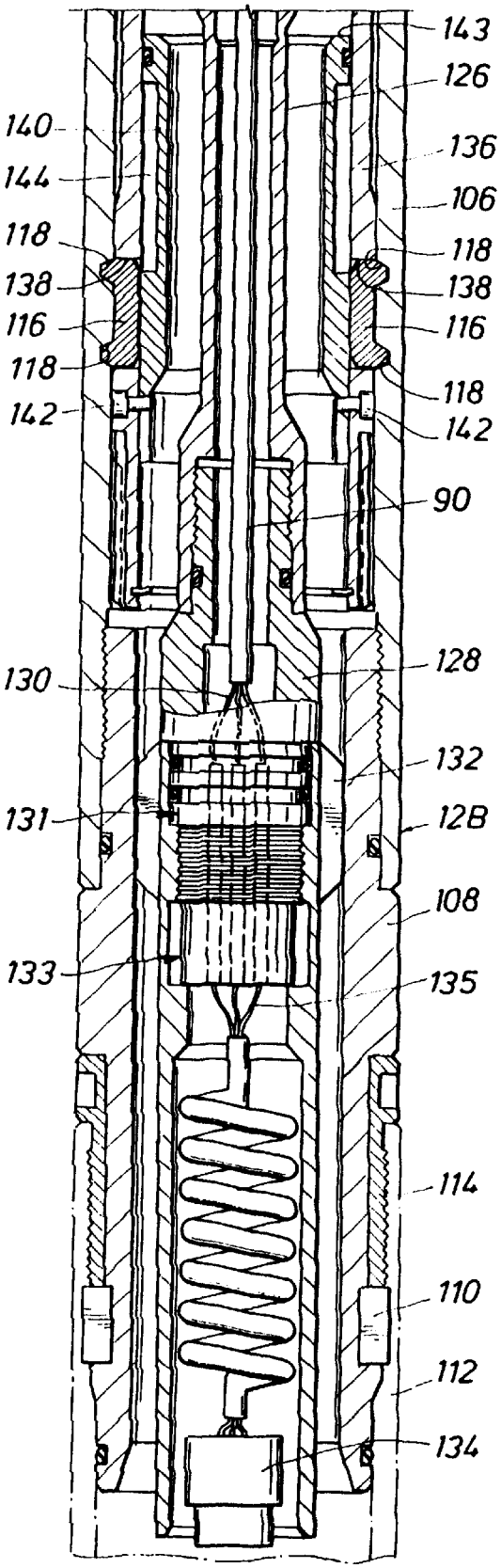

For releasably securing upper tool portion 12A to lower tool portion 12B, a plurality of separate locking dogs or latches 116 carried by upper portion 12A engage inner annular grooves 118 in the wall of lower housing 106 of lower portion 12B as shown in FIG. 1H. Upon release of latches 116 from grooves 118, upper tool portion 12A is disconnected and retrieved as will be explained further in reference to FIGS. 5A and 5B which show upper tool portion 12A disconnected from lower tool portion 12B for retrieval.

Fluid Pressure Actuating Mechanism For Tool Disconnect-FIGS. 3A, 3B, 4A and 4B.

A fluid pressure actuating mechanism which is activated electrically as will be explained further below is provided for the release of dogs or latches 116 to permit disconnect of upper portion 12A from lower portion 12B. As shown particularly in FIGS. 3A, 3B, 4A and 4B, upper tool portion 12A includes a disconnect actuator assembly generally indicated at 120 having a downwardly extending solenoid sub 122 with a small diameter lower end portion 123. An electrically operated solenoid valve is shown in 124 mounted on solenoid sub 122 and will be explained further below. A disconnect mandrel 126 extends downwardly from lower end portion 123 of sub 122 and a lower conductor housing 128 is secured to mandrel 126 for harness 90. Harness 90 has a plurality of conductors 130 secured to bulkhead 131. A plug 133 connected to bulkhead 131 has a jumper conductor harness 135 extending therefrom as shown in FIG. 1H. Splines 132 on housing 128 position housing 128 within crossover sub 108 of lower tool portion 12B. Jumper conductor harness 135 extends downwardly to plug 134 shown in FIG. 1H. Plug 134 is releasably connected to a mating harness portion (not shown) and is disconnected upon disconnect of upper tool portion 12A from lower tool portion 12B.

A dog housing 136 carries dogs 116 which are received within slots 138 in housing 136. A dog retainer sleeve 140 having an upper end 143 is mounted within dog housing 136 and secured therein by shear pins 142. A recess 144 in retainer sleeve 140 is adapted to receive dogs 116 upon the shearing of pins 142 and downward sliding movement of retainer sleeve 140. Dogs 116 move radially inwardly within recess 144 to release upper tool 12A for retrieval at surface.

Figure 3A:
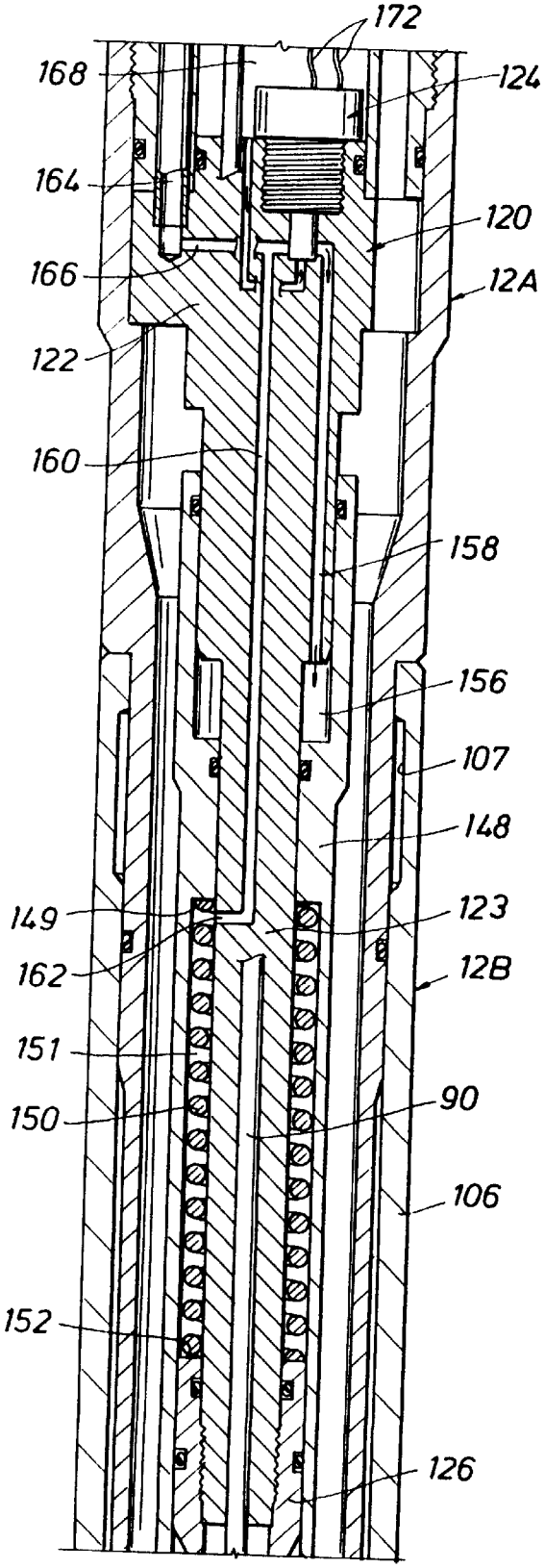
FIGS. 3A and 3B are continuous longitudinal sectional views of the fluid actuated release mechanism for unlocking the upper tool portion from the lower tool portion with the tool portions shown in the locked position in the deenergized position of an electric solenoid.
Figure 3B:
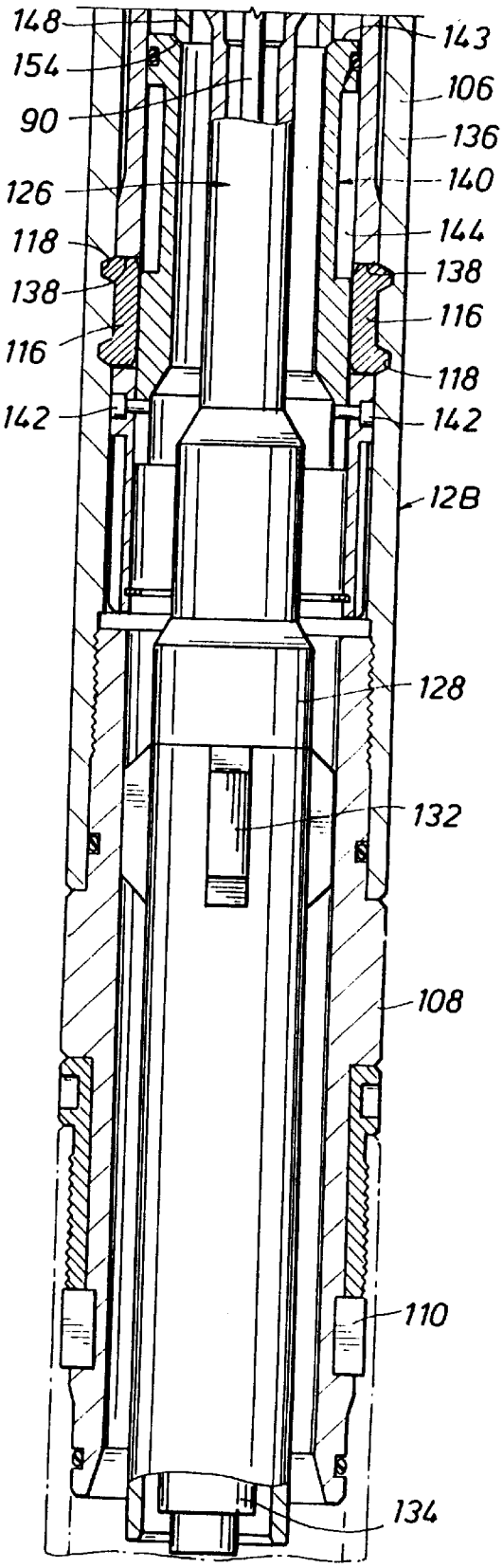
Figure 4A:
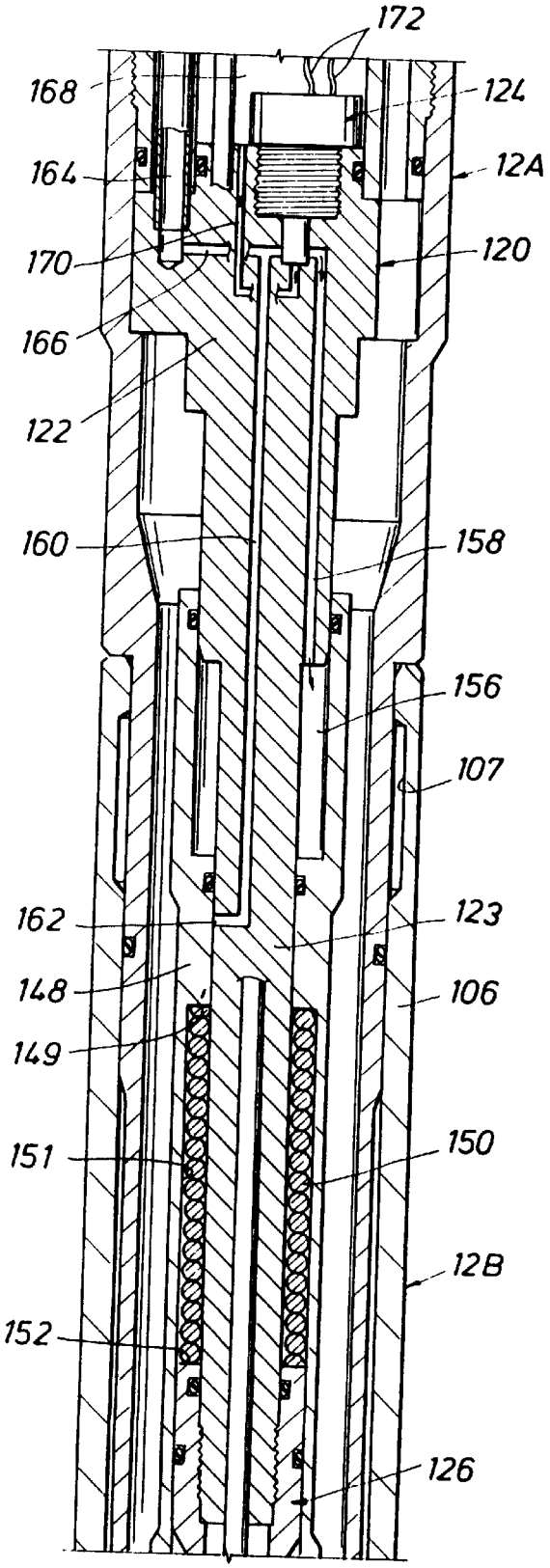
FIGS. 4A and 4B are continuous longitudinal sectional views similar to FIGS. 3A and 3B but showing the fluid actuated release mechanism in unlocked position after energizing of the electric solenoid for disconnect of the upper tool portion from the lower tool portion.
Figure 4B:
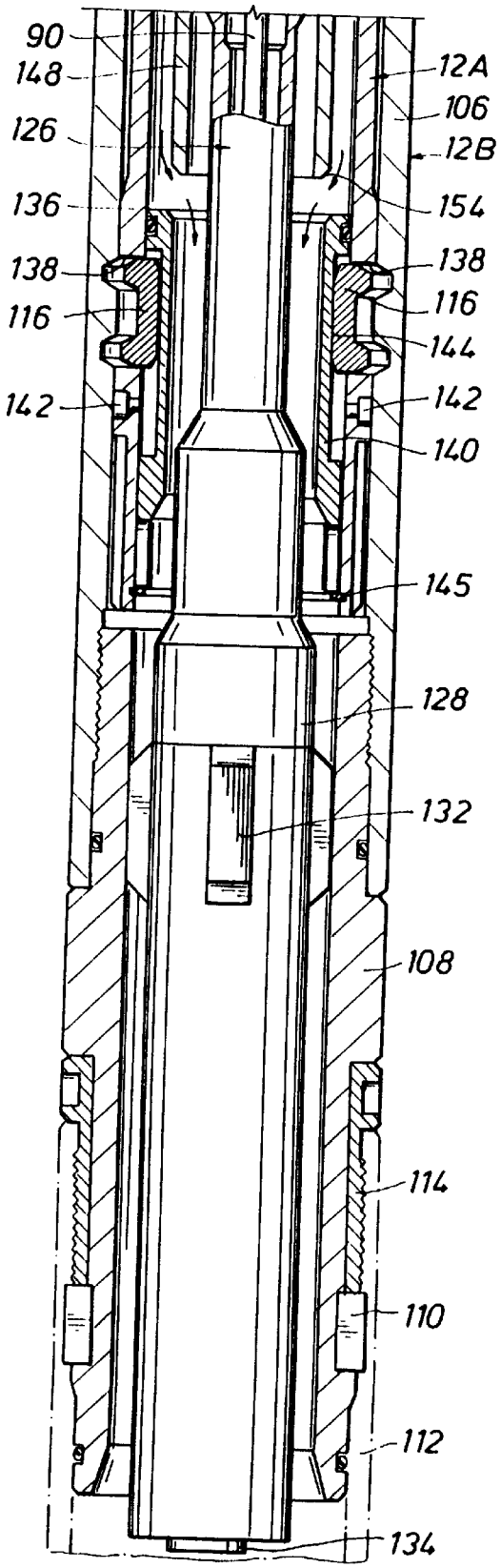

A disconnect piston 148 is mounted on solenoid sub 122 for sliding movement. A spring 150 mounted in a spring chamber 151 is biased between an upper shoulder 149 on disconnect piston 148 and an upper shoulder 152 on mandrel 126 to urge piston 148 continuously in an upward direction as shown in FIG. 1G in a non-actuated position. Disconnect piston 148 has a lower annular end 154 for contacting the upper end 143 of retainer sleeve 140 when pressure actuated for downward movement against the force of spring 150 as shown in FIGS. 3A and 3B. Shear pins 142 are sheared by retainer sleeve 140 resulting from the downward force of piston 148 when actuated for the release of locking dogs 116 as shown in FIG. 4B. As shown in FIGS. 1G and 1H, lower end 154 of disconnect piston 148 is axially spaced from upper end 143 of retainer sleeve 140 to permit the downward flow of annulus fluid. However, upon downward movement of piston 148 into contact with upper end 143 to increase the pressure differential area as shown in FIG. 3B, the downward flow of annulus fluid is blocked. This results in a high buildup of fluid pressure in the annular chamber above retainer sleeve 140 with fluid pressure increasing from about 300 psi to about 2000 psi in the annular chamber above sleeve 140. The high fluid pressure acting against end 143 of sleeve 140 is necessary in order to provide sufficient force for sleeve 140 to move downwardly against the frictional force generated by dogs 116 and to shear pins 142.

The upward flow of fluid in annulus 17 outside tool 12 is communicated to spring chamber 151 in the non-actuated position of piston 148 from port 163 and fluid passage 164 (see FIG. 1E) through crossport 166 and fluid passage 160 in solenoid sub 122 to port 162 communicating with spring chamber 151. Thus, spring 150 and fluid in chamber 151 maintain piston 126 in the fluid balanced position of FIGS. 1G and 1H until fluid actuation of piston 148.

For fluid actuation of piston 148, pressurized hydraulic fluid is supplied from a pressurized fluid reservoir 168 through fluid passage 170 in solenoid sub 122 and axial fluid passage 158 in sub 122 to fluid chamber 156. Piston 148 is actuated only upon (1) energizing of solenoid operated valve 124 from a surface location to permit pressurized hydraulic fluid to flow from pressurized fluid reservoir 168 to chamber 156 and (2) a predetermined fluid pressure differential between chamber 151 and chamber 156 after energizing of solenoid operated valve 124.

Figure 8:
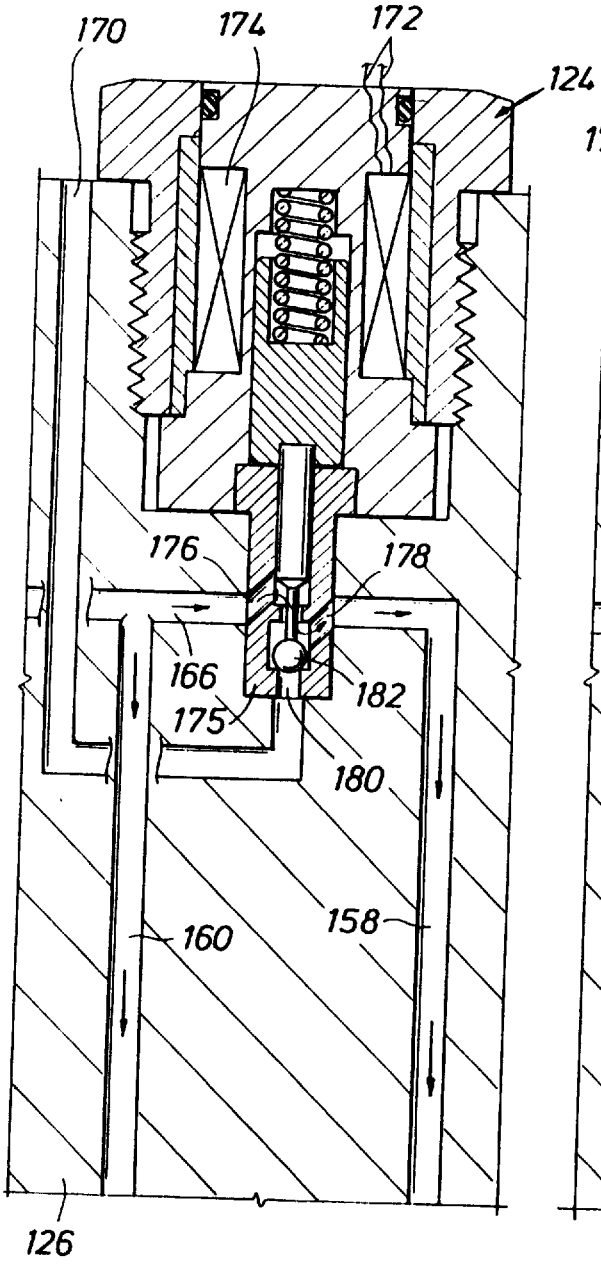
FIGS. 8 and 9 are sectional views showing fluid flow through the solenoid operated valve upon respective deenergized and energized positions of the solenoid.
Figure 9:
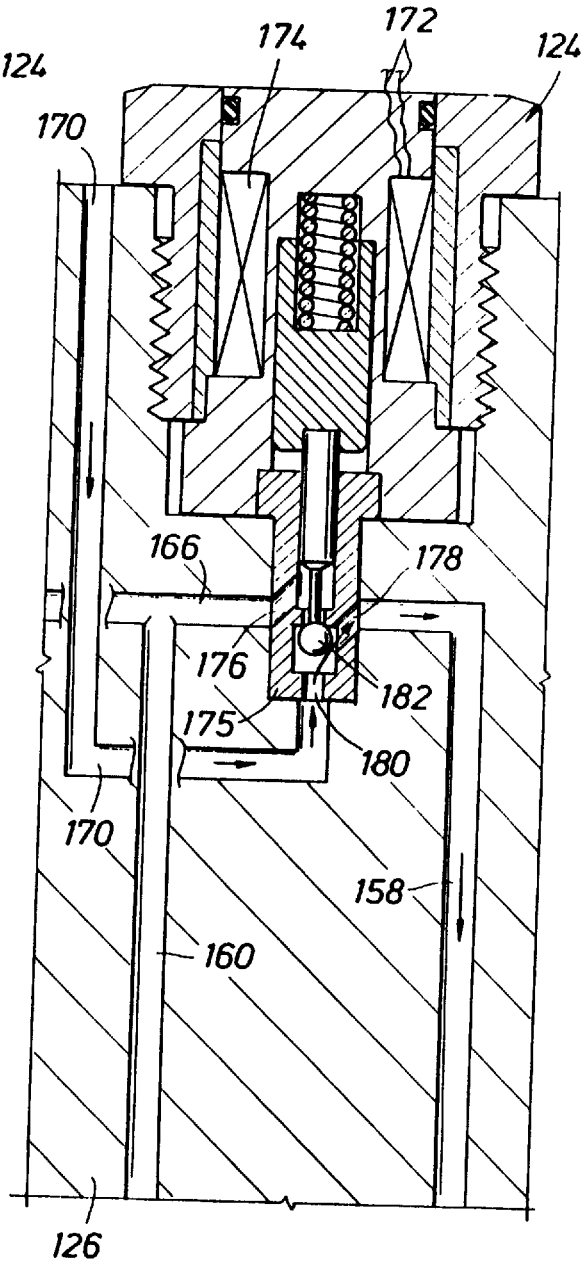

Electrical Activation of Fluid Pressure Actuating Mechanism-FIGS. 8 and 9

Referring now particularly to FIGS. 8 and 9, solenoid operated valve 124 is shown in a deenergized position in FIG. 8 to prevent fluid operation of disconnect piston 148 and in an energized position in FIG. 9 to permit fluid operation of disconnect piston 148. Coil 174 has a pair electrical conductors or leads 172 from harness 90 to supply electrical energy for energizing and deenergizing coil 174 from a surface location. A sleeve 175 has opposed side ports 176, 178 therein communicating with respective fluid passages 166 and 158. An end port 180 in sleeve 175 is in fluid communication with fluid passage 170 from the pressurized hydraulic fluid reservoir 168. A plunger operated ball member 182 closes port 180 and prevents fluid communication between fluid passages 170 and 158 in the deenergized position of solenoid valve 124 shown in FIG. 8. In the energized position shown in FIG. 9, fluid flow is blocked between fluid passages 166 and 158 and permitted between fluid passages 166 and 158, to provide pressurized hydraulic fluid to piston chamber 156. In the deenergized position of solenoid valve 124, the fluid pressure in chambers 151 and 156 is equalized for fluid balancing of piston 126 and piston 126 remains in the position of FIG. 1G under the influence of spring 150. In the energized position of solenoid valve 124 with a fluid pressure differential of around 300 psi between chambers 151 and 156, piston 128 will be actuated for disconnect of upper tool portion 12A from lower tool portion 12B.

Compensating Mechanism For Pressurized Hydraulic Fluid-FIGS. 1E, 1F, 6 and 7.

Pressurized hydraulic fluid is provided in reservoir 168 for supply to piston chamber 156 through fluid passage 170 upon energizing of solenoid valve 124. Reservoir 168 includes bore 96 in upper disconnect sub 95 and check valve mandrel 94. Reservoir 168 is charged with hydraulic fluid to a predetermined fluid pressure at surface through port 186 past valve 188. Thus, a separate hydraulic fluid line to surface is not required.

Figure 6:
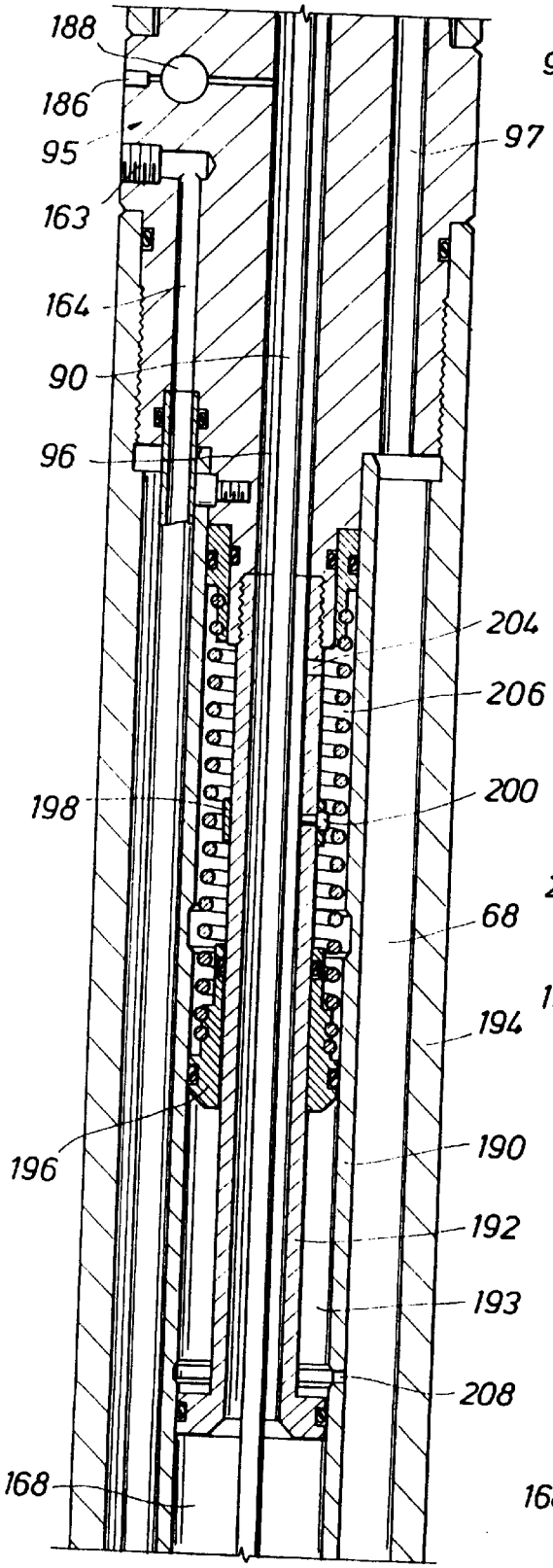
FIG. 6 is a sectional view of the pressurized hydraulic fluid reservoir including a pressure compensating piston therein with the piston shown in a balanced portion.
Figure 7:
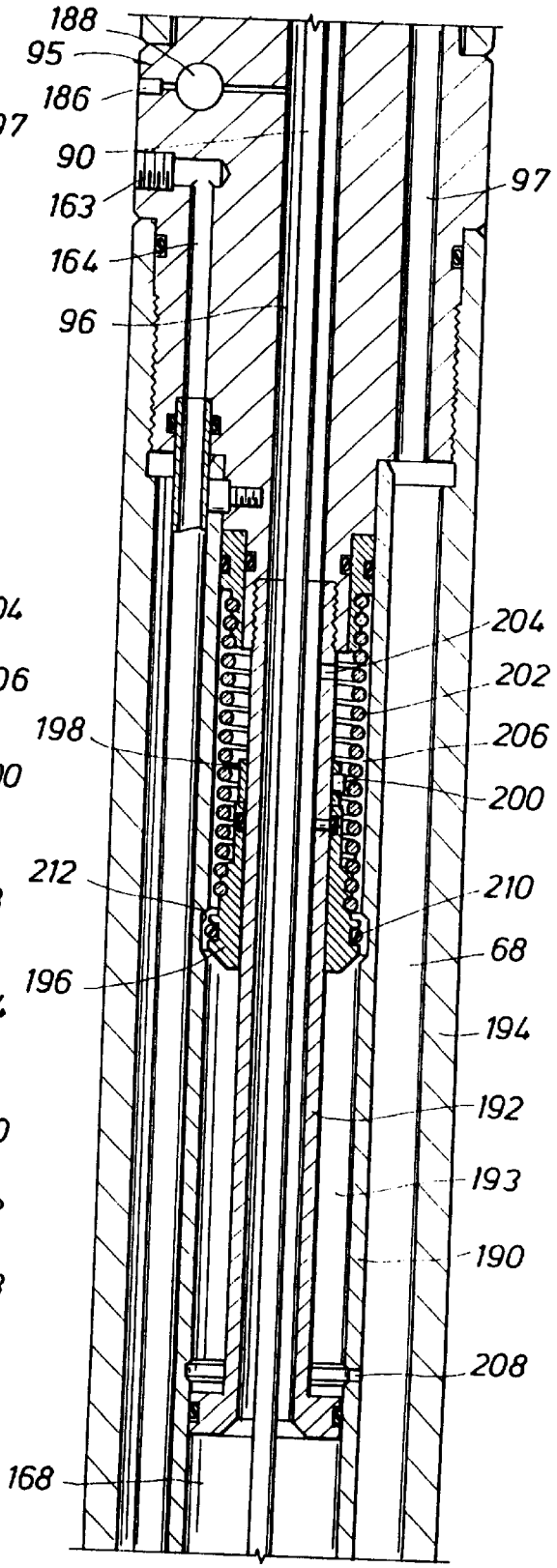
FIG. 7 is a sectional view similar to FIG. 6 but showing the pressure compensating piston in an inoperative position to permit bypassing of drilling fluid for actuation of the release mechanism.

As shown particularly in FIGS. 1F, 6 and 7 a compensation cylinder 190 is shown having a compensation rod 192 secured thereto and defining a fluid pressure chamber 193. An outer compensation housing 194 defines annulus 68 with compensation cylinder 190. A compensation piston 196 is mounted about compensation rod 192 for sliding movement. A stop ring 198 is secured to rod 192 by shear pins 200 and contacts piston 196 as shown in FIG. 1F when the hydraulic fluid pressure reaches a predetermined low pressure. FIG. 1F shows piston 196 in an uncharged position supported against ring 198. FIG. 6 shows piston 196 in a charged operable position for downhole operation and spaced from ring 198. FIG. 7 shows piston 196 in a bypass position in which the hydraulic fluid pressure has been reduced below a predetermined minimum pressure and annulus fluid is bypassing piston 196 upon shearing of shear pins 200.

A compensation spring 202 urges piston 196 upwardly. A port 204 in compensation rod 192 provides fluid communication between annular spring chamber 206 and reservoir 168. A port 208 in compensation cylinder 190 provides fluid communication between annulus 68 and annular chamber 193. Annulus fluid from annulus 68 is communicated to cylinder chamber 193 through port 208 for acting against piston 196 for pressurizing of the hydraulic fluid in reservoir 168. An O-ring 210 extends about piston 196. When the pressurized hydraulic fluid in reservoir 168 is reduced a predetermined amount, the pressure differential between the annulus fluid pressure in chamber 193 and the hydraulic fluid in reservoir 168 and chamber 206 is increased to effect shearing of pins 200. Piston 196 then moves upwardly with the bias of spring 202 and O-ring 210 thereon is received within a recess 212 in the wall of cylinder 190 as shown in FIG. 7 to permit a bypass of annulus fluid into hydraulic reservoir 168 through port 204. The bypassing of annulus fluid into hydraulic reservoir 168 is effective to activate the disconnect and unlock upper tool portion 12A from lower tool portion 12B upon the reduction of the hydraulic fluid pressure in reservoir 168 below a predetermined amount as might result from repeated actuation of locking dogs 116 and the disconnect. Each actuation of the disconnect results in a loss of hydraulic fluid from reservoir 168.

Operation of Electrically Activated Fluid Pressure Actuating Mechanism

In normal downhole operation, the tool 12 is shown in the position illustrated in FIGS. 1A–1H with compensation piston in the operable position shown in FIG. 6 instead of the position shown in FIG. 1F. Fluid pressure from passage 164 and annulus 17 is communicated through passages 158 and 160 to opposed faces of piston 148 for fluid balancing of piston 148 as shown particularly in FIGS. 1G, 1H and 8. To disconnect upper tool portion 12A and coiled tubing string 14 from lower tool portion 12B, solenoid valve 124 is energized from the surface by an electrical signal through wireline cable 16 and conductors 172 to move solenoid valve member 182 to the position shown in FIG. 9 in which pressurized hydraulic fluid from reservoir 168 is communicated through fluid passages 170 and 158 to fluid chamber 156 for urging disconnect piston 148 downwardly as shown in FIGS. 3A and 3B. A predetermined fluid pressure differential such as 300 psi for example, between the hydraulic fluid in passage 158 and the fluid pressure in passage 160 is required in order to actuate piston 148 against the force of spring 150. Upon downward movement of piston 148, the lower end 154 of piston 148 first contacts the upper annular end 143 of retainer sleeve 140 as shown particularly in FIG. 3B to block fluid flow down the annulus. After contact of piston 148 with retainer sleeve 140, the resulting increase in fluid pressure is detectable at a surface location. A buildup of fluid pressure above sleeve 140 results in further downward movement of piston 148 and sleeve 40 to shear pins 142 as shown in FIG. 3B to permit downward movement of sleeve retainer 140 to the position shown in FIG. 4B in which the lower end of sleeve retainer 140 contacts stop ring 145. In this position, dogs 116 are received within recess 144 out of engagement with annular grooves 118 in lower housing 136 thereby to disconnect upper tool portion 12A from lower tool portion 12B and permit retrieval of upper tool portion 12A as shown particularly in FIGS. 5A and 5B. Tensioning of coiled tubing string 14 from the surface effects removal and retrieval of upper tool portion 12A.

Upon disconnect of upper tool portion 12A from lower tool portion 12B, solenoid operated valve 124 may be deenergized to move valve member 182 to the position of FIG. 8 blocking the hydraulic fluid in fluid passage 158 and fluid chamber 156. The return of piston 148 to its original position shown in FIG. 1G forces hydraulic fluid from chamber 156 into fluid passages 166 and 164 instead of return to hydraulic fluid reservoir 168. As a result of the loss of hydraulic fluid upon each actuation of the disconnect, reservoir 168 may require recharging after five or six actuations of the disconnect mechanism. After each disconnect, tool 10 is returned to the surface and reassembled for another downhole operation. Upon retrieval of upper tool portion 12A to surface, fishing tools, jars or the like can then be run back in the borehole and latched onto fishing neck 107 and crossover sub 108 for fishing operations.

While the locking mechanism has been illustrated as locking dogs, it is to be understood that other types of latches or releasable locking mechanisms may be utilized between upper tool portion 12A and lower tool portion 12B. While the electrical activating means has been illustrated as a solenoid operated valve in the drawings, it is to be understood that other types of electrical activating means for the fluid pressure actuating mechanism may be utilized.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. In a downhole tool disconnect system for a well having a tubing string extending downhole and a tool connected to the tubing string, the tool having a disconnect joint between an upper tool portion connected to a lower end of the tubing string and a lower tool portion releasably connected to said upper tool portion; an improved release mechanism for said release joint comprising:

releasable locking means for releasably connecting said lower tool portion to said upper tool portion adjacent said disconnect joint;

fluid operated release means operatively connected to said releasable locking means for unlocking of said locking means upon activation of said fluid operated release means and subsequent actuation of said release means; and electrical means operatively connected to said fluid operated release means to provide an electrical signal to said fluid operated release means to activate said fluid operated release means and permit actuation thereof upon a predetermined fluid pressure differential between an internal fluid in the tubing string and external fluid in the well.

2. In a downhole tool disconnect system as set forth in claim 1 wherein:

said fluid operated means includes a piston operable at a predetermined fluid pressure differential between external fluid in an annulus outside said tool and internal fluid within said tool.

3. In a downhole tool disconnect system as set forth in claim 1 wherein:

a hydraulic fluid reservoir is provided in said tool for pressurized hydraulic fluid for actuation of said fluid operated release means; said hydraulic fluid in said reservoir being pressurized by annulus fluid flowing down said tubing string and said tool.

4. In a downhole tool disconnect system as set forth in claim 3 wherein:

a piston is operatively connected to said hydraulic fluid reservoir for pressurizing hydraulic fluid therein, said piston being exposed on one side thereof to annulus fluid and exposed on an opposed side to hydraulic fluid.

5. In a downhole tool disconnect system as set forth in claim 1 wherein:

a cylinder is mounted within said tool receiving said piston for reciprocal movement; and a rod is mounted centrally of said cylinder; said piston being mounted on said rod within said cylinder for reciprocal movement.

6. In a downhole disconnect system as set forth in claim 5 wherein:

a stop member for said piston is mounted on said rod; and shear pins releasably secure said stop member to said rod, said shear pins being sheared upon said piston contacting said stop member under a predetermined force from said drilling fluid for movement of said piston to a position to permit drilling fluid to bypass said piston for pressurizing said hydraulic reservoir to permit actuation of said disconnect upon a drop of pressure in said hydraulic fluid reservoir below a predetermined minimum amount.

7. In a downhole disconnect system as set forth in claim 1 wherein:

said electrical means comprises a solenoid operated valve operable when energized to permit a flow of pressurized hydraulic fluid to said fluid operated release means, said solenoid operated valve when deenergized preventing flow of pressurized hydraulic fluid to said fluid operated release means.

8. In a downhole disconnect system as set forth in claim 7 wherein:

a hydraulic fluid reservoir is provided in said tool; and pressurizing means responsive to annulus fluid pressurizes hydraulic fluid within said hydraulic fluid reservoir.

9. In a downhole tool release system as set forth in claim 1 wherein:

said tubing string comprises coiled tubing and said electrical means comprises a wireline cable which extends through said coiled tubing to provide an electrical signal for activating said release means.

10. In a downhole tool release system as set forth in claim 9 wherein:

a clamp within said tool is secured to said electrical cable adjacent the lower end of said coiled tubing for anchoring said wireline cable thereat; and cable release means responsive to tension forces exerted by said electrical cable connected to said clamp to release said clamp and wireline cable for retrieval from said coiled tubing.

11. In a downhole tool release system as set forth in claim 1 wherein:

said locking means comprises a plurality of latches between said tool portions movable between locked and unlocked positions.

12. A fluid operated release means for a downhole tool having a disconnect joint between an upper tool portion connected to a tubing string and a lower tool portion releasably connected to the upper tool portion; said fluid operated release means comprising:

a hydraulic fluid reservoir in said tool;

means responsive to pressurized drilling fluid in said tool to pressurize hydraulic fluid in said hydraulic fluid reservoir;

releasable locking means for releasably connecting said lower tool portion to said upper tool portion;

a piston operatively connected to said locking means to effect unlocking thereof upon actuation of said piston;

fluid passage means between said hydraulic fluid reservoir and said piston; and valve means in said fluid passage means to permit in one position the flow of pressurized hydraulic fluid from said reservoir to said piston for actuation of said piston and unlocking of said locking means to disconnect said upper portions from said lower tool portion.

13. A fluid operated release means as set forth in claim 12 wherein:

said hydraulic fluid reservoir include a cylinder, a piston mounted within said cylinder for pressurizing hydraulic fluid therein; and means permitting the flow of pressurized drilling fluid within said cylinder for forcing said piston against the hydraulic fluid for pressurizing the hydraulic fluid.

14. A fluid operated release means as set forth in claim 13 wherein:

a rod is fixedly mounted within said cylinder and said piston is mounted on said rod for relative reciprocal movement.

15. A fluid operated release means as set forth in claim 14 wherein said piston has an annular seal thereon for sealing against the inner surface of said cylinder and said cylinder has an inner annular groove therein to receive said annular seal therein in a fully retracted position of said piston when the pressurized hydraulic fluid is below a predetermined fluid pressure, said pressurized drilling fluid bypassing said piston in the fully retracted position of said piston to permit the flow of annulus fluid into said hydraulic fluid reservoir.

16. A fluid operated release means for a downhole tool having a disconnect joint between an upper tool portion connected to a coiled tubing string and a lower tool portion releasable connected to the upper tool portion, the tool having an outer housing and a wireline cable extending centrally of said outer housing to define an annulus therebetween, said fluid operated release means comprising:

a source of hydraulic fluid;

means responsive to pressurized annulus fluid in said tool to pressurize said hydraulic fluid;

releasable locking means for releasably connecting said lower tool portion to said upper tool portion including a plurality of latches engaging said outer housing in a latched position and a slidable sleeve in the annulus maintaining said latches in latched position;

a plurality of shear members releasably holding said slidable sleeve in an upper position for maintaining said latches in locked position; and a piston mounted above said slidable sleeve and effective upon actuation thereof from pressurized hydraulic fluid to force said sleeve downwardly for shearing said members and releasing said latches for disconnect of said upper tool portion from said lower tool position.

17. A fluid operated release means as set forth in claim 16;

said piston and said slidable sleeve are spaced vertically from each other in the latched position of said latches to permit annular fluid flow between said piston and said sleeve, said piston when actuated by pressurized hydraulic fluid moving downwardly into contact with said slidable sleeve to block annular fluid flow and effect a pressure buildup above said sleeve acting against said sleeve, said piston and said sleeve being forced downwardly by respective pressurized hydraulic fluid and pressurized annulus fluid for shearing said members to release said latches for disconnect of said upper tool portion.

18. A fluid operated release means as set forth in claim 17 wherein;

a surface detectable fluid pressure change is provided upon contact of said piston against said slidable sleeve.

* * * * *